US008978521B2

(12) United States Patent
Layton

(10) Patent No.: US 8,978,521 B2
(45) Date of Patent: Mar. 17, 2015

(54) TORQUE ADAPTER WITH RATCHET REVERSE FEATURE

(71) Applicant: United Technologies Corporation, Hartford, CT (US)

(72) Inventor: Bruce H. Layton, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 296 days.

(21) Appl. No.: 13/622,030

(22) Filed: Sep. 18, 2012

(65) Prior Publication Data

US 2014/0076111 A1 Mar. 20, 2014

(51) Int. Cl.

| | |
|---|---|
| ***B25B 13/46*** | (2006.01) |
| ***B25B 13/48*** | (2006.01) |
| ***B25B 23/00*** | (2006.01) |
| ***F01D 25/28*** | (2006.01) |

(52) U.S. Cl.

CPC ..... *B25B 13/481* (2013.01); *B25B 13/46* (2013.01); *B25B 23/0021* (2013.01); *F01D 25/285* (2013.01); *F05D 2230/60* (2013.01); *F05D 2240/60* (2013.01); *Y10T 29/49826* (2015.01)

USPC ..... 81/63.1; 81/180.1

(58) Field of Classification Search

USPC ..... 81/60–63.2, 177.2, 180.1, 462, DIG. 8, 81/124.7

See application file for complete search history.

(56) References Cited

U.S. PATENT DOCUMENTS

| | | | | | |
|---|---|---|---|---|---|
| 471,539 | A | * | 3/1892 | Everitt | 81/63 |
| 755,293 | A | * | 3/1904 | George | 81/63.2 |
| 1,018,080 | A | * | 2/1912 | Reston | 81/63.2 |
| 3,039,339 | A | * | 6/1962 | Hanson | 81/177.2 |
| 5,269,207 | A | | 12/1993 | Kutzler | |
| 5,499,559 | A | | 3/1996 | Lin | |
| 5,687,623 | A | | 11/1997 | Hsieh | |
| 6,089,128 | A | * | 7/2000 | Kopyless | 81/177.2 |

* cited by examiner

*Primary Examiner* — Hadi Shakeri

(74) *Attorney, Agent, or Firm* — Carlson, Gaskey & Olds, PC

(57) ABSTRACT

A torque transmittal tool has an input socket to receive a drive input from a drive tool. The input socket causes a first link to rotate through a range of rotation upon rotation of the input socket. The first link is fixed to rotate with an extension link. The extension link is fixed to rotate with an output link. The output link includes an output ratchet for transmitting rotation, and has a torque reversal button which may be actuated to change the direction of rotation of the output ratchet. An actuator has an unactuated position where a contact surface is spaced away from the torque reversal button, and an actuated position at which it actuates the torque reversal button. A method is also disclosed.

16 Claims, 2 Drawing Sheets

TORQUE ADAPTER WITH RATCHET REVERSE FEATURE

RESEARCH OR DEVELOPMENT

This invention was made with government support under Contract No. F33657-99-D-2051 awarded by the United States Air Force. The Government has certain rights in this invention.

BACKGROUND OF THE INVENTION

This application relates to a work tool for transmitting torque, wherein a drive ratchet is provided with a direction-reversing feature.

Various types of tool are known for transmitting torque between an input and an output. One known type of tool is utilized to assemble tie rods in gas turbine engines. The tool has an input which receives a drive wrench, and receives rotation centered along a first axis. By turning this tool, a linkage is driven through an angular range, such that rotation is transmitted axially to an underside of the tool, and then back through a ratchet output. The specifications for assembling tie rods require that there be serially tightening and loosening of nuts and/or bolts.

Ratchets are provided with a direction-reversing button that can be actuated to reverse the direction that the nut will be driven as the ratchet turns. However, in some work applications, the button is not easily accessible, and an assembly person must repeatedly remove the tool, actuate the button, and then re-install the tool.

SUMMARY OF THE INVENTION

In a featured embodiment, a torque transmittal tool has an input socket to receive a drive input from a drive tool. The input socket causes a first link to rotate through a range of rotation upon rotation of the input socket. The first link is fixed to rotate with an extension link, which is fixed to rotate with an output link. The output link includes an output ratchet for transmitting rotation, and has a torque reversal button that may be actuated to change a direction of rotation of the output ratchet. An actuator for the output link has an unactuated position where a contact surface is spaced away from the torque reversal button, and an actuated position at which the contact surface actuates the torque reversal button.

In another embodiment according to the previous embodiment, the actuator is a fork having arms extending along a side of the output link. The output link is biased outwardly relative to the fork. The fork is moveable relative to the output link such that one of the arms is the contact surface for actuating the torque reversal button.

In another embodiment according to any of the previous embodiments, a guide on at least one side of the output link is guided in a slot on at least one of the arms in the fork.

In another embodiment according to any of the previous embodiments, there are guides on both of two sides of the output link, and received in a slot in each of the arms.

In another embodiment according to any of the previous embodiments, a spring biases the output link outwardly of the fork.

In another embodiment according to any of the previous embodiments, the spring biases a pin which is in contact with the output link.

In another embodiment according to any of the previous embodiments, the fork has an extending portion extending away from the arms in a direction away from the output socket such that the extending portion is easily accessible during a work application.

In another embodiment according to any of the previous embodiments, a spring biases the output link to the unactuated position.

In another embodiment according to any of the previous embodiments, the spring biases a pin which is in contact with the output link.

In another embodiment according to any of the previous embodiments, the actuator has an extending portion extending away from the arms in a direction away from the output socket such that the extending portion is easily accessible during a work application.

In another featured embodiment, a method of assembling includes the steps of rotating an input socket with a drive tool, and the input socket causing a first link to rotate through a range of rotation. The first link is fixed to rotate with an extension, which is fixed to rotate with an output link. The output link rotates an output ratchet on a member to be tightened or loosened. The output ratchet has a torque reversal button that may be actuated to change the direction of rotation of the output ratchet. An actuator is moved for the output link from an unactuated position where a contact surface is spaced away from the torque reversal button, to an actuated position at which the contact surface actuates the torque reversal button.

In another embodiment according to the previous embodiment, the actuator is a fork having arms extending along a side of the output link, with the output link biased outwardly relative to the fork. The fork is moveable relative to the output link such that one of the arms is the contact surface for actuating the torque reversal button.

In another embodiment according to any of the previous embodiments, a guide on at least one side of the output link is guided in a slot on at least one of the arms in the fork.

In another embodiment according to any of the previous embodiments, there are guides on both of two sides of the output link, and received in a slot in each of the arms.

In another embodiment according to any of the previous embodiments, a spring biases the output link outwardly of the fork.

In another embodiment according to any of the previous embodiments, the spring biases a pin which is in contact with the output link.

In another embodiment according to any of the previous embodiments, the fork has an extending portion extending away from the arms in a direction away from the output socket such that the extending portion is easily accessible during a work application.

In another embodiment according to any of the previous embodiments, a spring biases the output link to the unactuated position.

In another embodiment according to any of the previous embodiments, the spring biases a pin that is in contact with the output link.

In another embodiment according to any of the previous embodiments, the actuator has an extending portion extending away from the arms in a direction away from the output socket such that the extending portion is easily accessible during a work application.

These and other features may be best understood from the following drawings and specification.

DETAILED DESCRIPTION

Figure 1:
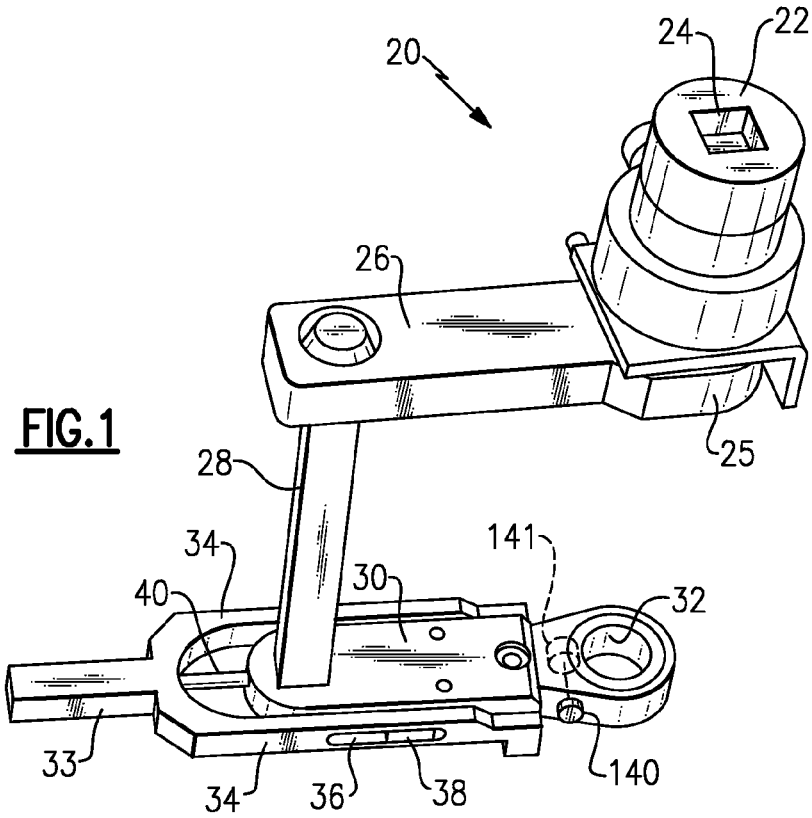
FIG. 1 shows a torque transmitting tool.

A tool 20 is illustrated in FIG. 1 having a drive input socket 22 with a square 24 to receive a drive input. A socket drive 25 operates as known to receive rotation from input 22 and cause a first link 26 to rotate through an angular range. Link 26 is connected to an extension link 28, which is in turn fixed to an output link 30. Link 30 drives an output ratchet 32 which may be received on a bolt or nut to be tightened or loosened.

A fork 33 includes side arms 34 with slots 36 receiving guide members 38 from the output link 30. The fork is an actuator as will be disclosed. A pin 40 biases the output link 30 to the position illustrated in FIG. 1.

A button 140 operates as known to allow the reversal of direction of the output ratchet 32 when rotation is received from the linkage 26/28/30. That is, when the first link 26 rotates extension link 28 to rotate output link 32 in one direction, the output ratchet 32 can be driven to rotate in either direction. A connection 141 causes this reversal whenever button 140 is actuated. Connection 141 may be as known.

Figure 2:
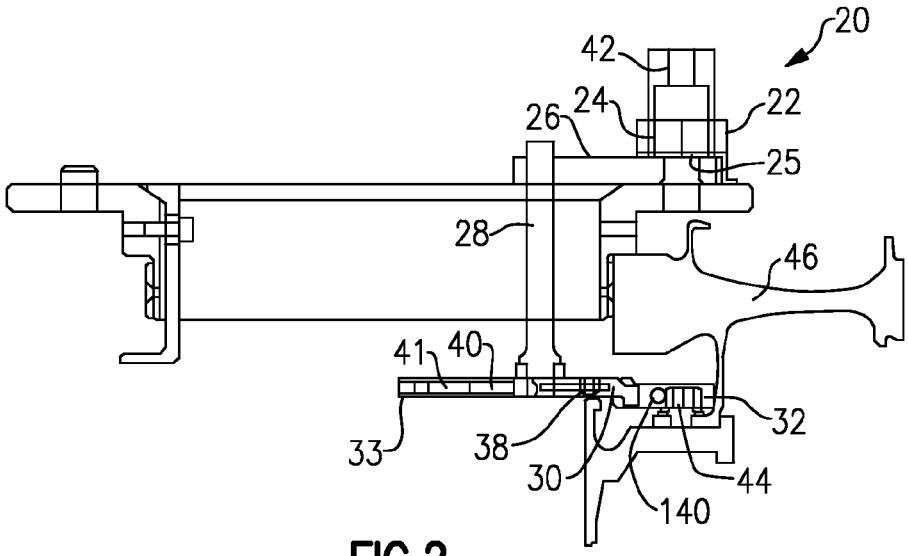
FIG. 2 shows a work application for the FIG. 1 tool.
Figure 3A:
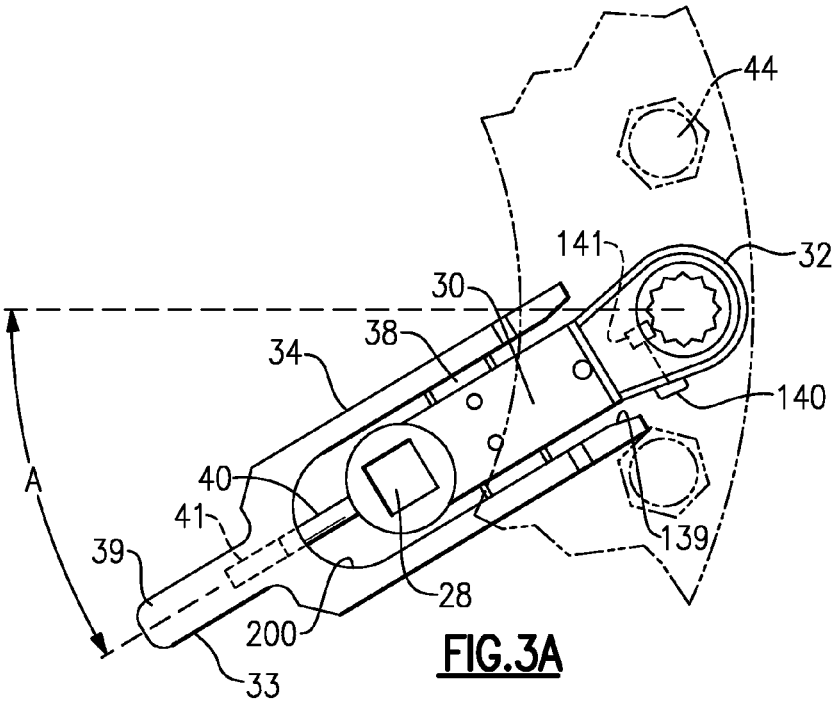
FIG. 3A shows an output end of the tool.

As shown in FIG. 2, the extension link 28 allows input from a tool 42 to cause socket 25 to rotate linkage 26/28/30 through an angular range (see angle A in FIG. 3A).

By doing this, the input at 22 translates to a colinear output at output ratchet 32, on a bolt 44. The purpose of the three-bar linkage provided by links 26/28/30 is to move beyond a portion 46 of the work piece that is being assembled. In the illustrated embodiment, this may all be part of a gas turbine engine.

The specifications for assembling the work piece 46 require repeated tightening and then loosening of associated bolts (44) or nuts. It would be most efficient if an assembler could simply actuate the reversal through the direction-reversing button 140. However, it is not accessible due to the remainder of the work piece 46.

Thus, in the prior art, an assembler has been required to repeatedly remove the tool, actuate the button, and then reassemble the tool. The use of the fork 33 in combination with the link 30 overcomes this limitation in the prior art.

As shown in FIG. 3A, a spring 41 biases pin 40 and output link 30 outwardly of a channel 200 in fork 33. The output link 30 is shown mounted on one of several heads of bolts 44 that are to be tightened and then loosened. The torque reversal button 140 is shown to be outward and beyond the end of the arms 34. However, button 140 would not be accessible to an assembler.

Figure 3B:
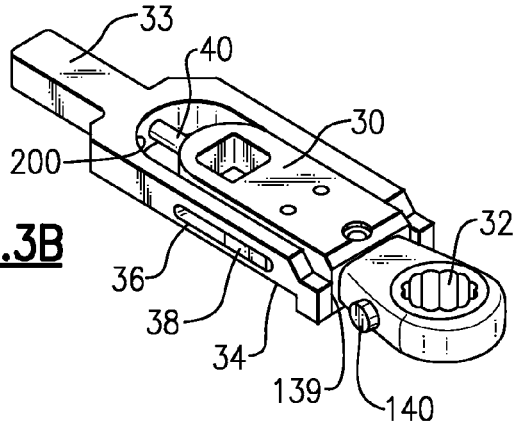
FIG. 3B shows another view of the output end.

As shown in FIG. 3B, guides 38 are received in slots 36, such that the output link 30 can move under the bias of spring 41 and pin 40.

Figure 3C:
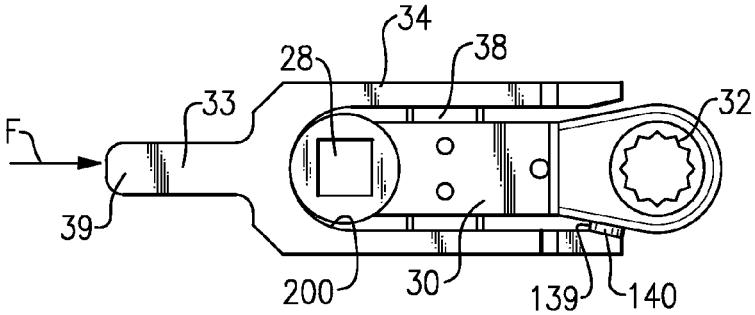
FIG. 3C shows an actuated position of the output end.

As shown in FIG. 3C, the fork 33 has now been forced against the spring force 41 such that the arms 34 now move towards the button 140 and one contacts the direction-reversing button 140. A contact surface 139 actually contacts the button 140. With this contact, the direction that the ratchet 32 will turn has been changed. The assembler need not disassemble the tool, but merely apply a force F, such as at the extending end portion end 39 of the fork 33. Portion 39 is easily accessible during assembly.

In the non-actuated position shown in FIG. 3B, the fork 33, which is an actuator, has contact surface 139 spaced from button 140. Contact surface 139 is in contact with the button 140 in the actuated position of FIG. 3C.

Once the button 140 has been actuated, the force F can be released, the spring 41 and pin 40 will bias the arms 34 back away from the button 140, and back to the FIG. 3A/3B position, and assembly can continue, with the ratchet 32 now turning the bolt head 44 in the opposed direction.

With the disclosed invention, the complexity of the assembly process is greatly reduced, as is the time required.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A torque transmittal tool comprising:

an input socket to receive a drive input from a drive tool, and said input socket causing a first link to rotate through a range of rotation upon rotation of said input socket, said first link being fixed to rotate with an extension link, and said extension link being fixed to rotate with an output link, said output link including an output ratchet for transmitting rotation, and said output ratchet having a torque reversal button which may be actuated to change a direction of rotation of said output ratchet;

an actuator for said output link, said actuator having an unactuated position where a contact surface is spaced away from said torque reversal button, and having an actuated position at which said contact surface actuates said torque reversal button; and said actuator is a fork having arms extending along a side of said output link, with said output link being biased outwardly relative to a channel in said fork, and said fork being moveable relative to said output link such that one of said arms is said contact surface for actuating said torque reversal button.

2. The tool as set forth in claim 1, wherein a guide on at least one side of said output link is guided in a slot on at least one of said arms in said fork.

3. The tool as set forth in claim 2, wherein there are guides on both of two sides of said output link, and received in a slot in each of said arms.

4. The tool as set forth in claim 3, wherein a spring biases said output link outwardly of said channel.

5. The tool as set forth in claim 4, wherein said spring biases a pin which is in contact with said output link.

6. The tool as set forth in claim 5, wherein said fork having an extending portion extending away from said arms in a direction away from said output socket such that said extending portion is easily accessible during a work application.

7. The tool as set forth in claim 1, wherein a spring biases said output link to said unactuated position.

8. The tool as set forth in claim 7, wherein said spring biases a pin which is in contact with said output link.

9. A method of assembling comprising the steps of:

rotating an input socket with a drive tool, and said input socket causing a first link to rotate through a range of rotation, said first link being fixed to rotate with an extension, and said extension being fixed to rotate with an output link, said output link rotating an output ratchet on a member to be tightened or loosened, and said output ratchet having a torque reversal button which may be actuated to change a direction of rotation of said output ratchet;

moving an actuator for said output link from an unactuated position where a contact surface is spaced away from said torque reversal button, and to an actuated position at which the contact surface actuates said torque reversal button; and said actuator is a fork having arms extending along a side of said output link, with said output link being biased outwardly relative to a channel in said fork, and said fork being moveable relative to said output link such that one of said arms is said contact surface for actuating said torque reversal button.

10. The method as set forth in claim 9, wherein a guide on at least one side of said output link is guided in a slot on at least one of said arms in said fork.

11. The method as set forth in claim 10, wherein there are guides on both of two sides of said output link, and received in a slot in each of said arms.

12. The method as set forth in claim 11, wherein a spring biases said output link outwardly of said channel.

13. The method as set forth in claim 12, wherein said spring biases a pin which is in contact with said output link.

14. The method as set forth in claim 13, wherein said fork having an extending portion extending away from said arms in a direction away from said output socket such that said extending portion is easily accessible during a work application.

15. The method as set forth in claim 9, wherein a spring biases said output link to said unactuated position.

16. The method as set forth in claim 15, wherein said spring biases a pin which is in contact with said output link.

* * * * *